US005349711A

United States Patent [19]

Iwami

[11] Patent Number: 5,349,711

[45] Date of Patent: Sep. 27, 1994

[54] CLOTH TREATMENT METHOD

[75] Inventor: Hideo Iwami, Kyoto, Japan

[73] Assignee: Naigai Special Dying Co., Ltd., Kyoto, Japan

[21] Appl. No.: 919,413

[22] Filed: Jul. 27, 1992

[30] Foreign Application Priority Data

Jul. 29, 1991 [JP] Japan ..... 3-212615

[51] Int. Cl.[5] ..... D06B 3/32

[52] U.S. Cl. ..... 8/152; 68/180; 68/177; 68/207

[58] Field of Search ..... 8/151, 152; 68/180, 68/5 C, 5 B, 177, 207

[56] References Cited

U.S. PATENT DOCUMENTS

| | | | |
|---|---|---|---|
| 3,483,720 | 12/1969 | Inada | 68/177 |
| 3,616,663 | 11/1971 | Matsuda | 68/177 X |
| 3,837,801 | 9/1974 | Shmuel | 8/152 |
| 4,005,500 | 2/1977 | Rayment | 8/152 |
| 4,793,014 | 12/1988 | Luigi | 68/177 X |
| 5,046,209 | 9/1991 | Keilhack | 68/180 |

FOREIGN PATENT DOCUMENTS

| | | | |
|---|---|---|---|
| 633955 | 8/1936 | Fed. Rep. of Germany | 68/177 |
| 2823530 | 12/1979 | Fed. Rep. of Germany | 68/177 |
| 2949423 | 6/1981 | Fed. Rep. of Germany | 68/177 |
| 1588943 | 4/1970 | France | 68/177 |
| 2412637 | 8/1979 | France | 68/177 |
| 45-25351 | 8/1970 | Japan | 68/177 |
| 47-23994 | 3/1972 | Japan | 68/177 |

*Primary Examiner*—Frankie L. Stinson

*Attorney, Agent, or Firm*—Lowe, Price, LeBlanc & Becker

[57] ABSTRACT

Length of an elongated belt-like cloth receivable in a treatment tank is increased by a compact and simple mechanism, and, moreover, impact force applied to the cloth is enhanced, whereby efficiency in cloth treatment such as washing in water, scouring, dyeing and treatment quality are improved. A treatment tank 10 used in carrying out the invention is divided into a front chamber 12 and a rear chamber 14, and a cylindrical rotary member 28 comprising a plurality of rods 30 arranged to form a cylinder is disposed on the midway of a passage 26 communicating the two chambers. A predetermined length of the cloth 20 is fed into the treatment tank, and the cylindrical rotary member is rotated alternately in forward and reverse directions, whereby conveyance of the cloth is repeated between the front and rear chambers, and during such repetition of conveyance, a required treatment is applied to the cloth.

1 Claim, 1 Drawing Sheet

CLOTH TREATMENT METHOD

BACKGROUND OF THE INVENTION

1. Field of the Invention

The present invention relates to a method for applying various treatments such as washing in water, scouring, dyeing to an elongated belt-like cloth in treatment tanks.

2. Description of Prior Art

Hitherto, for applying various treatments such as washing in water, scouring, dyeing to an elongated belt-like cloth, a plurality of rollers are disposed in two rows upper and lower in a treatment tank, and a cloth to be treated is wound over or taken up on the rollers in sequential order so as to be conveyed drawing a locus of meandering up and down (vertical meandering), while supplying a cleaning liquid and others to the cloth during such conveyance. In another prior system, moving conveyors are disposed in the treatment tank, and a cloth to be treated in a folded state is placed on the moving conveyor. A cleaning liquid is applied to the cloth while conveying the cloth continuously, and a pressure block of a cloth retainer disposed on the way of moving passage is caused to move up and down, whereby a pressure is applied to the cloth in the folded state, resulting in improvement of treatment effect.

In each of the mentioned prior methods, however, a problem exists in that the movement or conveyance of the cloth to be treated is rather slow, and moreover the movement of the pressure block for applying a pressure to the cloth is also slow, resulting in poor impact force applied to the cloth. Hence, to improve treatment effect of the cloth, it is required to extend the conveying distance of the cloth in the treatment tank by increasing number of the rollers and/or increasing the length of the moving conveyer, for example, which brings about another problem of increase in full length or enlargement in dimensions of the treatment apparatus itself.

SUMMARY OF THE INVENTION

The present invention was made to solve the above-discussed problems and has an object of providing a novel method for treating cloth in which capacity of receiving a cloth to be treated in the treatment tank is enhanced by a simple mechanism without increasing size of the treatment apparatus, and impact force applied to the cloth is increased, whereby treatment effect is improved.

To accomplish the foregoing object, in a cloth treatment method in accordance with the invention, a treatment apparatus is employed. In this treatment apparatus, a treatment tank is divided into a front chamber and a rear chamber, and on the midway of a passage communicating the mentioned two chambers, a cylindrical rotary member comprising a plurality of rods is arranged to form a rotatably supported cylinder. Thus, the cloth treatment method comprises the steps of: feeding an elongated belt-like cloth to be treated into the treatment tank; stopping such feed of the cloth at the time when a predetermined length of the cloth has been received in an inner bottom of the front chamber; driving the cylindrical rotary member so as to convey the cloth at high speed from the front chamber to the rear chamber while causing the cloth taken up on the cylindrical rotary member to contact sequentially each of the rods forming a cylindrical surface of the cylindrical rotary member; stopping such conveyance of the cloth to the rear chamber at the time when a predetermined length of the cloth has been received in an inner bottom of the rear chamber; driving the cylindrical rotary member in reverse direction so as to convey the cloth at high speed while causing the cloth taken up on the cylindrical rotary member to contact sequentially each of the rods; stopping such conveyance of the cloth to the front chamber at the time when a predetermined length of the cloth is received in the inner bottom of the front chamber; repeating the mentioned every step of conveyance of the cloth between the front and rear chambers a required number of times; applying a treating solution such as washing water from injection pipes respectively provided in the front and rear chambers as well as in the vicinity of the cylindrical rotary member to the cloth during the repetition of the mentioned every step; and sending out the cloth of which treatment has been completed and which has been received in the inner bottom of the treatment tank. The mentioned steps of operation are repeated after feeding a new cloth to be subsequently treated into the treatment tank.

In the cloth treatment method of above arrangement, capacity of receiving a cloth to be treated in the treatment tank may be enhanced. Furthermore, since the cloth is conveyed at high speed from the front chamber to the rear chamber and vice versa while causing the cloth to contact sequentially each rod of the cylindrical rotary member, an impact force is applied to the cloth due to the contact between the cloth and each rod during the conveyance, thereby the cloth being rubbed, kneaded and squeezed. Thus, in the treatment of washing in water, for example, soil components are effectively removed from the cloth.

It is also preferable that a high pressure air is mixed with a water or hot water, and the high pressure air is spouted together with the water or hot water to the cloth from injection pipes each disposed in the front and rear chambers and in the vicinity of the cylindrical rotary member. In this arrangement, impact energy applied to the cloth is further enhanced by the high pressure air applied from the injection pipe, thus a further effective treatment being performed.

Since the cloth treatment method in accordance with the invention has an arrangement and performs a function as mentioned above, treatment effect of cloth may be improved just by using a compact and simple mechanism, and efficiency in cloth treatment such as washing in water or scouring and quality of the treatment are both improved.

Other objects and advantages of the invention will become apparent in the course of the following description with reference to the accompanying drawings.

DESCRIPTION OF THE PREFERRED EMBODIMENTS

Figure 1:
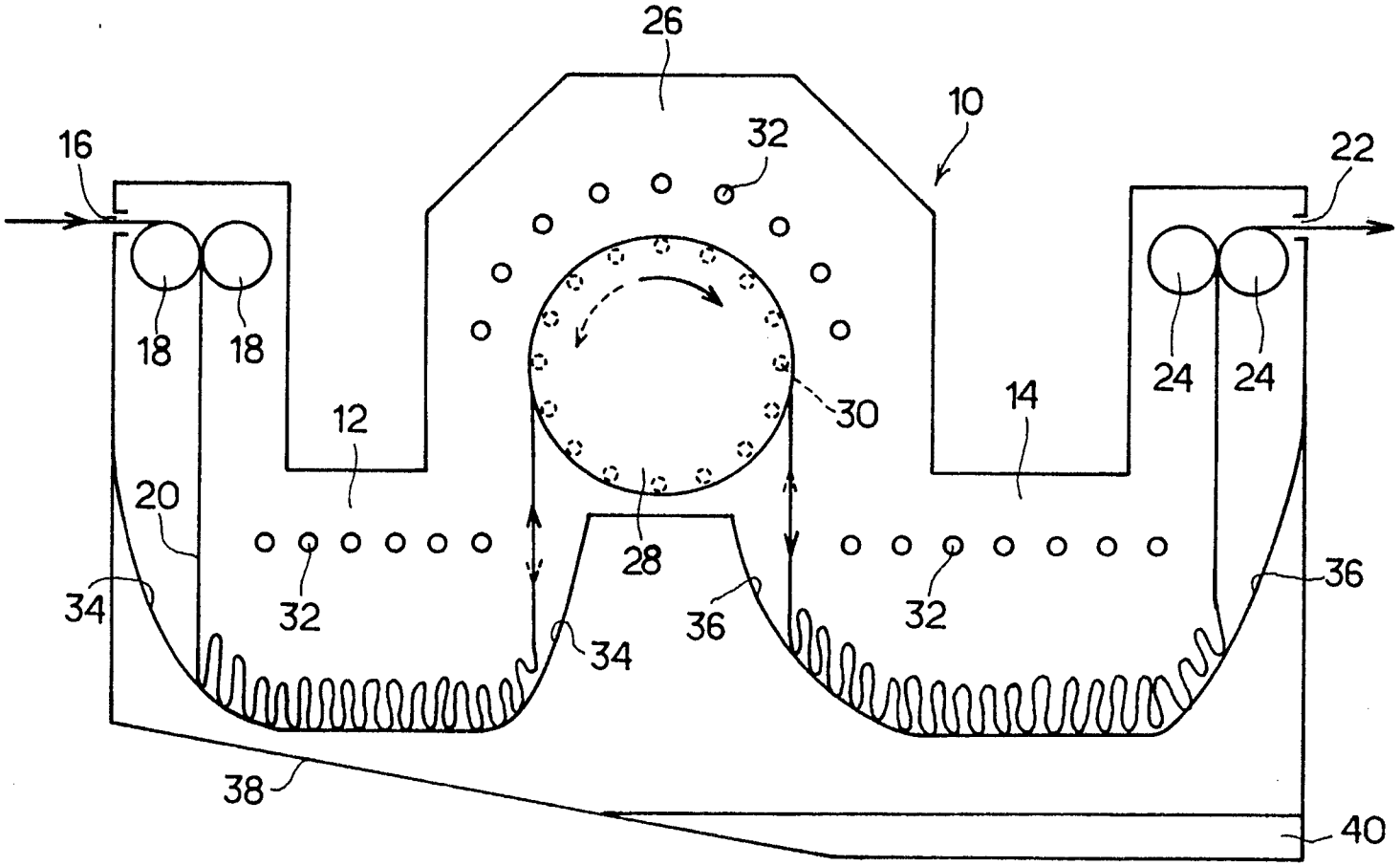
FIG. 1 is a schematic view showing an example of cloth treatment apparatus used in embodying the method in accordance with the present invention.

A preferred embodiment of the present invention is hereinafter described.

FIG. 1 shows a schematic view of an example of cloth treatment apparatus used in carrying out the method in accordance with the present invention. A treatment tank 10 of this apparatus is divided into two sections, i.e., a front chamber 12 and a rear chamber 14. The front chamber 12 is provided with a feed port 16 for feeding a cloth 20 to be treated, and a pair of feed rollers 18, 18 are disposed in the vicinity of the feed port 16. On the other hand, the rear chamber 14 is provided with a delivery port 22 for discharging or delivering the treated cloth 20, and a pair of delivery rollers 24, 24 are disposed in the vicinity of the delivery port 22. On the midway of a passage communicating the front and rear chambers 12, 14, a cylindrical rotary member 28 is disposed so as to be rotatably supported. The cylindrical rotary member 28 comprises a plurality of rods 30, and two ends of each rod 30 are respectively fixed to corresponding side plates so that a cylindrical surface is formed by arranging the plurality of rods 30 circumferentially. Inside the front and rear chambers 12, 14 and around the cylindrical rotary member 28, injection pipes 32 provided with injection jets facing to the cloth 20 are respectively disposed. Every injection pipe 32 is connected through a passage to an air and water feeder (not illustrated) for feeding a mixture of high pressure air and water or hot water. Inner bottoms of the front and rear chambers 12, 14 are respectively formed into curvatures 34, 36 partially. The inner bottoms are provided with a large number of drain holes so that water spouted through the injection pipes 32 toward the cloth 20 to be treated, consumed and caused to flow down to the inner bottoms may be drained out of the treatment tank 10 through those drain holes. The water discharged out of the treatment tank 10 is reserved in a drain tank 40 provided at the bottom of a housing 38. It is also preferable that a circulating pump is connected to the drain tank 40 so as to supply water from the circulating pump to the injection pipes 32, thus utilizing the water in a form of circulating water. It is also preferable the curvatures 34, 36 of the inner bottoms of the front and rear chambers 12, 14 are provided with a conveyor or a sensitive roller lattice as a device for applying slight shock or vibration to the cloth.

Described hereinafter is a sequence for applying a treatment such as washing in water using the treatment apparatus mentioned above. First, the feed rollers 18 are driven to feed the elongated belt-like cloth 20 to be treated into the treatment tank 10 through the feed port 16. In this step, the cylindrical rotary member 28 is not driven but kept in the stopped state. When a predetermined length of the cloth 20 has been received in a folded manner at the inner bottom of the front chamber 12, the feed rollers 18 are stopped, thereby the feed of the cloth 20 into the treatment tank 10 being also stopped. Then, the cylindrical rotary member 28 is driven to rotate in the direction of the solid line arrow in FIG. 1 by a driving gear not illustrated so that the cloth 20 wound over the cylindrical surface of the rotary member is conveyed at high speed from the front chamber 12 to the rear chamber 14. At the same time, a high pressure air mixed with water is applied to the cloth 20 from the injection jet of every injection pipe 32 disposed inside the front and rear chambers 12, 14 as well as in the vicinity of the cylindrical rotary member 28. In this step, the feed rollers 18 and the delivery rollers 24 are not driven but kept in the stopped state. It is to be noted that, during this step of conveyance, since the cloth 20 is conveyed at high speed while contacting sequentially each of the rods 30 forming the cylindrical surface of the cylindrical rotary member 28, an impact force generated at the moment of contacting each rod 30 is applied to the cloth 20, and besides another impact force due to the high pressure air and water from the injection pipes 32 is additionally applied thereto, thus an increased impact force being applied to the cloth 20. It is also to be noted that since the cloth 20 received in folded state in the front chamber 12 is stretched by taking it up on the cylindrical surface of the cylindrical rotary member 28 and, then, received in the rear chamber 14 in folded strate, the cloth 20 is sufficiently rubbed, kneaded and squeezed through such folding and stretching while contacting the rods 30.

When most of the cloth 20 has been fed into the rear chamber 14 and a predetermined length of the cloth 20 has been received in the inner bottom of the rear chamber 14, rotation of the cylindrical rotary member 28 is stopped, whereby conveyance of the cloth 20 into the rear chamber 14 is stopped. Then, the cylindrical rotary member 28 is driven by the driving gear to rotate in the reverse direction, i.e., in the direction of the dot line arrow in FIG. 1, whereby the cloth 20 is conveyed at high speed from the rear chamber 14 to the front chamber 12. Also in this step, the high pressure air is applied together with water to the cloth 20 through the injection jets of the injection pipes 32. And the feed rollers 18 and the delivery rollers 24 are not driven but kept in the stopped state. When most of the cloth 20 has been conveyed from the rear chamber 14 to the front chamber 12, the rotation of the cylindrical rotary member 28 is stopped. Further, the cylindrical rotary member 28 is driven to rotate again in the direction of the solid line arrow in FIG. 1, whereby the cloth 20 is conveyed from the front chamber 12 to the rear chamber 14. The mentioned conveyance operation of the cloth between the front and rear chambers are repeated required number of times. Finally, the delivery rollers 24 are driven so that the cloth 20 which has been treated and received in the inner between of the rear chamber 14 may be sent out of the treatment tank 10 through the delivery port 22.

In the process of the foregoing operation, an impact force and squeezing action are applied to the predetermined length of cloth 20, whereby soil is removed from the treated cloth 20. The removed solid is drained out of the treatment tank 10 together with water through the holes provided at the inner bottoms of the front and rear chambers 12, 14 to be reserved in the drain tank 40 at the bottom of the housing 38. Subsequently, a predetermined length of cloth 20 to be treated nextly is fed into the treatment tank 10, and washing treatment thereof is performed by repeating the foregoing operation.

Showing an example of specific numeric value as to the foregoing treatment, feed rate of the cloth 20 into the treatment tank 10 by means of the feed rollers 18 was set to 20 m/min, and the cloth 20 was fed into the treatment tank 10 for 10 min so that the cloth 20 of 200 m in length was received in the treatment tank. Rate of conveyance of the cloth from the front chamber 12 to the rear chamber 14 and that from the rear chamber 14 to the front chamber 12 were respectively set to 100 m/min. Duration of the conveyance of the cloth at one time was set to continue for 1 min and 48 sec, whereby 180 m of 200 m of the cloth 20 was conveyed at one time of conveyance, remaining 20 m thereof in the starting chamber. Treatment time in the treatment tank 10 was set to about 10 to 15 min, and number of times for repeating the conveyance of the cloth between the two chambers was set to 5 to 7. Delivery rate for delivering the treated cloth out of the treatment tank 10 by means of the delivery rollers 24 was set to 20 m/min.

Though the washing treatment of cloth in water is described in the foregoing example, the treatment method in accordance with the invention is not limited thereto but preferably applicable to other treatments such as scouring, dyeing. The solution supplied from the injection pipes to the cloth may be varied or assorted to meet various types of treatment.

What is claimed is:

1. A method of treating a cloth which comprises the steps of:

feeding an elongated belt-like cloth to be treated into a treatment tank which is divided into a front chamber and a rear chamber, and in which a cylindrical rotary member comprising a plurality of rods is arranged on the midway of a passage communicating said mentioned two chambers, to form a rotatably supported cylinder;

stopping said feed of the cloth at the time when a predetermined length of the cloth has been received in an inner bottom of the front chamber;

driving the cylindrical rotary member so as to convey the cloth at high speed from the front chamber to the rear chamber while causing the cloth taken up on the cylindrical rotary member to sequentially contact each of the rods forming a cylindrical surface of the cylindrical rotary member so that the cloth is rubbed, kneaded and squeezed by the plurality of rods of the rotary member;

stopping said conveyance of the cloth to the rear chamber at the time when a predetermined length of the cloth has been received in an inner bottom of the rear chamber;

driving the cylindrical rotary member in reverse direction so as to convey the cloth at high speed while causing the cloth taken on the cylindrical rotary member to sequentially contact each of the rods;

stopping said conveyance of the cloth to the front chamber at the time when a predetermined length of the cloth is received in the inner bottom of the front chamber;

repeating said every step of conveyance of the cloth between the front and rear chambers required number of times;

applying a treating solution such as washing water from injection pipes respectively provided in the front and rear chambers and in the vicinity of the cylindrical rotary member to the cloth during the repetition of said every step; and sending out the cloth of which treatment has been completed and which has been received in the inner bottom of the treatment tank, wherein a high pressure air is mixed with a water or hot water, and the high pressure air is supplied together with the water or hot water to the cloth through each of the injection pipes disposed in the front and rear chambers and in the vicinity of the cylindrical rotary member.

* * * * *